US006688978B1

(12) United States Patent
Herman

(10) Patent No.: US 6,688,978 B1
(45) Date of Patent: Feb. 10, 2004

(54) EVENT CONTEST METHOD

(76) Inventor: Bob Herman, 464 Fantasy, Palmdale, CA (US) 93551

( * ) Notice: Subject to any disclaimer, the term of this patent is extended or adjusted under 35 U.S.C. 154(b) by 110 days.

(21) Appl. No.: 09/804,716

(22) Filed: Mar. 12, 2001

Related U.S. Application Data

(60) Provisional application No. 60/189,415, filed on Mar. 15, 2000.

(51) Int. Cl.[7] ..... A63F 9/24
(52) U.S. Cl. ..... 463/25; 700/91; 700/92
(58) Field of Search ..... 700/91, 92; 463/25

(56) References Cited

U.S. PATENT DOCUMENTS

| | | | | | |
|---|---|---|---|---|---|
| 4,108,361 | A | * | 8/1978 | Krause | 235/375 |
| 4,842,275 | A | * | 6/1989 | Tsatskin | 273/440 |
| 5,713,793 | A | | 2/1998 | Holte | |
| 5,713,795 | A | | 2/1998 | Kohorn | |
| 5,749,785 | A | | 5/1998 | Rossides | |
| 5,846,132 | A | | 12/1998 | Junkin | |
| 5,916,024 | A | | 6/1999 | Von Kohorn | |
| 5,971,854 | A | | 10/1999 | Pearson et al. | |
| 6,015,345 | A | * | 1/2000 | Kail | 273/138.1 |
| 6,120,376 | A | * | 9/2000 | Cherry | 273/139 |
| 6,292,706 | B1 | * | 9/2001 | Birch et al. | 273/317.6 |

OTHER PUBLICATIONS

John Scarne, Scarne's New Complete Guide to Gambling, 1961, 1974, Simon & Schuster, 109–173.*

MotorSport F1 Pick 6, http://www.motorsport.com/compete/p6/rules.asp, Mar. 4, 2000.*

PolitiStockElection Pool Contest, http://www.politistock.com/contest–ep.shtml, 2000.*

Pick the Pros Football Contest, http://www.pickthepros.com/ptp_rules.html.*

The History of Pick 6, Motorsport.com, http:/www.motorsport.com/complete/p6/history.asp, 1994–2003.*

David Wasserman, More Than Enough Answers to Questions Nobody Asked about F1 Pick 6, http://members.shaw.CA/david.wasserman/f1p6anal.pdf, 1996.* vol. 25 Issue 10 College & Pro Newsweekly Football Sep. 30—Oct. 6, 1999 Article.

* cited by examiner

*Primary Examiner*—Jessica Harrison
*Assistant Examiner*—Corbett B Coburn
(74) *Attorney, Agent, or Firm*—Robert Ryan Morishita; Anderson & Morishita, LLC

(57) ABSTRACT

A contest decided by the outcome of an event includes a participant selecting a subset of predetermined size from a finite pool of event competitors. Optionally, the participant places a wager to participate. Optionally, the participant's selections are ranked. At a predetermined point in the event, an index is calculated for each participant based on the aggregate performance of the participant's selected subset. Each index is calculated by summing a statistic generated during the event for each of the participant's selections. Participants are ordered by index and, optionally, a predetermined number of participants are awarded prizes. Tied indexes are resolved by comparing the statistics of competitors in the tied subsets. Optionally, the comparison is in the order in which the participants ranked the selections. Optionally, the reward is derived by pooling wagers.

6 Claims, 1 Drawing Sheet

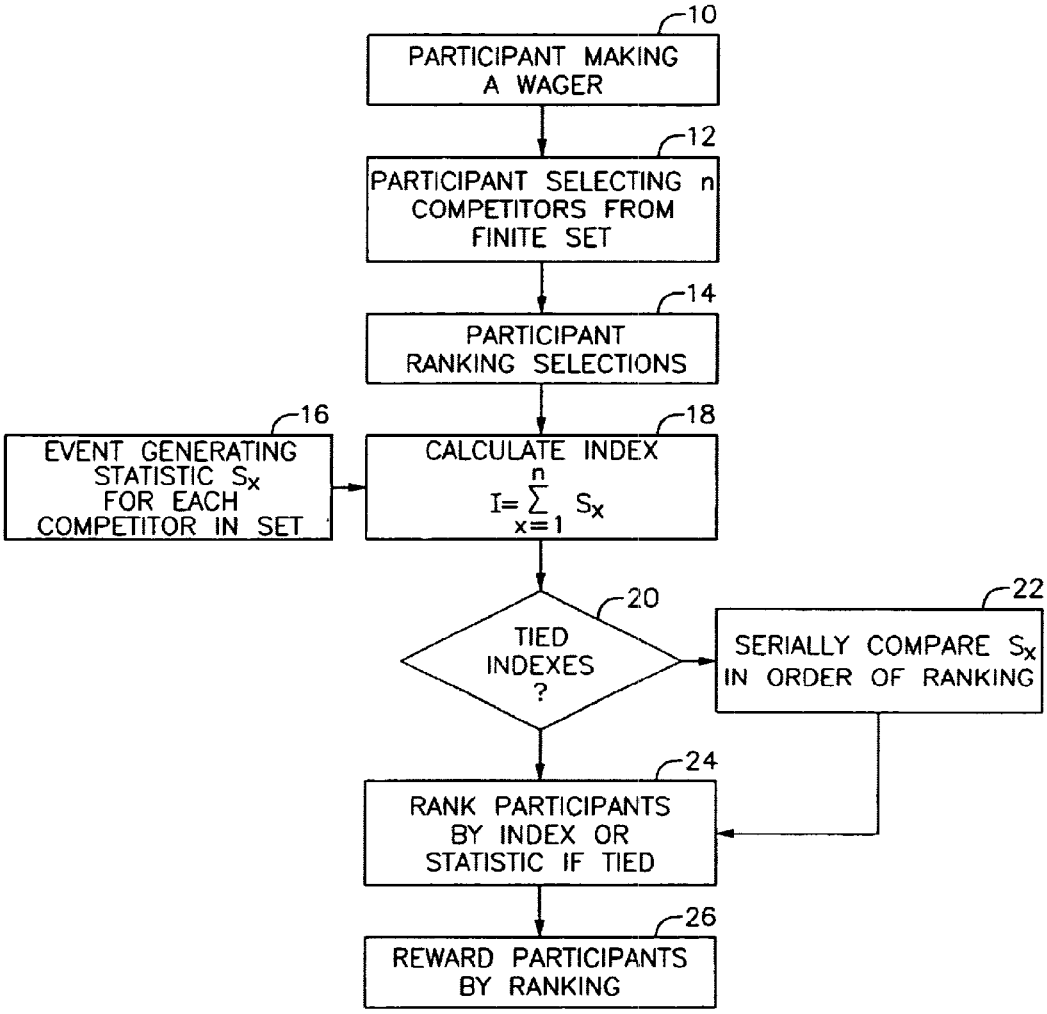
10
PARTICIPANT MAKING A WAGER
12
PARTICIPANT SELECTING n COMPETITORS FROM FINITE SET
14
PARTICIPANT RANKING SELECTIONS
16
EVENT GENERATING STATISTIC $S_x$ FOR EACH COMPETITOR IN SET
18
CALCULATE INDEX $I=\sum_{x=1}^{n} S_x$
20
TIED INDEXES ?
22
SERIALLY COMPARE $S_x$ IN ORDER OF RANKING
24
RANK PARTICIPANTS BY INDEX OR STATISTIC IF TIED
26
REWARD PARTICIPANTS BY RANKING

EVENT CONTEST METHOD

RELATED APPLICATION DATA

The present application claims the priority of U.S. Provisional Application Serial No. 60/189,415 entitled "Event Wagering Method" filed Mar. 15, 2000 by Applicant herein.

FIELD OF THE INVENTION

The present invention relates to event contest methods. Specifically, the present invention is a method for conducting a contest, the outcome of which is determined by an event or set of events, such as sporting events, where a participant selects a subset of competitors and contest winners are decided by the aggregate performance of the competitors within the participant's subset.

BACKGROUND OF THE INVENTION

There are various techniques and games known in the prior art for individuals to wager on sporting events. For example, it is known to provide what are commonly referred to as "rotisserie baseball leagues" or "fantasy leagues" as described in Pearson, U.S. Pat. No. 5,971,854. In such leagues, the participants of the games select or draft the names of professional players to be on their fantasy team. During the course of the sporting season, points are awarded to each participant based on certain tracked statistics for the players selected to the participant's team. For example, in a fantasy baseball league, statistics such as runs batted in, batting average, earned run average, strike outs and the like for each player may be tracked and used during the season to award points to the participants' fantasy teams. The participant having the team with the greatest aggregate statistics wins the contest and, in certain embodiments, is awarded a prize. These fantasy leagues have been played many sports such as football, hockey, basketball, and the like.

Such fantasy leagues, however, do not feature wagering upon the actual outcome of one or more actual sporting events. That is, in a fantasy league, a participant selects the best players for his or her fantasy team without regard to any player's team record because the player's team record is irrelevant to the participant's score. If a participant wishes to wager on the outcome of a particular sporting event, a participant must play a different game or contest.

To accommodate those wishing to wager on the outcome of a sporting event, it is known in the art for a host or casino to book futures or proposition wagers related to specified outcomes concerning certain sporting events. For purely entertainment purposes or in certain jurisdictions which permit sports wagering, it is known to provide future proposition wagers for sporting events. These include wagers on the eventual winner, the final score, or any specific statistic. As an example, a casino sports book may provide a listing of future proposition wagers and posted odds for each participating golfer in a golf tournament. A participant wishing to wager on the tournament would place a wager and select a specific golfer that the participant believes will win. Typically in exchange for the wager, the participant will receive a ticket or stub indicating that the wager has been made. If the golfer wins, the participant claims his reward by presenting the ticket stub. The participant is paid at the posted odds.

Another form of this common wager available at casino sports books, for example, is a wager on the outcome of a particular game. To maintain parity on both sides of the wager, that is, to insure that gamblers are more or less equally divided between two competing teams, casinos utilize mechanisms such as a point spread or odds. The point spread is a number calculated by the casino to be the winning margin. For example, if a gambler wagers on a game in which Team A is favored by five points, five points is the point spread. For the gambler to win the wager, Team A must not only win, but must additionally win by more than five points. If Team A loses or wins by five or fewer points, the gambler loses the wager.

With respect to the examples discussed above, there are several aspects of the wager according to the prior art which increase the gambler's risk. First and foremost is that sport books treat each game or tournament as a separate event. In other words, unless the participant plays parlay cards, as described hereinafter, wagers on different games are resolved separately. For example, a participant that wagers on five football games must select five winners to win all five wagers.

To alleviate this problem somewhat, parlay cards have been created to reduce the participant's risk. In a parlay card, a participant selects the winners for a predetermined number of games. For example, in a ten game parlay, a participant selects the winners in ten different games. If the participant correctly selects a predetermined number of winners, the player is rewarded. In the example above, ten correct out of ten selections may entitle a participant to a first prize, nine correct out of ten selections may entitle a participant to a second prize, and so forth.

One drawback of parlay cards is that parlay cards still utilize point spreads. Thus, as stated above, it is not enough to project the winner, but a participant must also project whether the winner will beat the point spread. The point spread is often a source of frustration for sports bettors for the very reason that a participant may correctly select the winning team but the winning team may not beat the point spread, resulting in a loss of the wager. Thus, it is often disadvantageous for a participant to select a "sure thing" because the point spread associated with that game or event is calculated by the sports book to be sizeable to attract wagers on both sides. Even in sports not utilizing a point spread, such as golf tournaments or horse racing, odds are used to encourage gamblers to allocate wagers among several different possible winners. These limitations and drawbacks exists for many sports or events such as horse racing, e.g. future propositions as to the horse which will win, place or show at the Kentucky Derby, team sports such as hockey, soccer, baseball and basketball, basketball tournaments such as the National Collegiate Athletic Association ("NCAA") basketball tournament, golf tournaments, Olympic events and other events where a favorite must overcome a point spread or poor odds to result in a winning wager.

Therefore, it can be seen that there is a need in the art for an event contest system the outcome of which is determined by the outcome of an event in which participants are encouraged to allocate their selections among several different possible outcomes without resort to point spreads or odds.

SUMMARY OF THE INVENTION

The contest of the present invention includes a participant selecting, from a finite pool of competitors, a subset consisting of a predetermined number of competitors. As examples, each participant may select five golfers from the entrants in a golf tournament or five football teams that the participant expects to win from a pool of twenty football games, that is, forty football teams. In an embodiment including head to head competition, a participant may be excluded from selecting competitors competing head to head. Thus, in the example above, participants wagering on golf could select any five golfers from the finite pool of entrants whereas participants wagering on football would be excluded from selecting both competitors in a single football game.

At a predetermined point in the sporting event or events, such as after the sporting event or events are completed, an outcome is generated by calculating an index for each participant. Each index is calculated by summing a statistic generated during the sporting event or events for each of the participant's selections. For example, in an optional embodiment, the statistic may be the margin of victory. Alternatively, the statistic used may be the score. The participants are ordered by index and a predetermined number of participants are awarded prizes. In the event of a tie, the tied participants' selections are compared and one or more selections differentiating the participants' subsets are determined. Tied participants are then ordered according to the statistic for the differentiating selection. In a further optional embodiment, participants rank their selections and tied indexes are resolved by comparing the statistics in the order of the ranked selections. Again, tied participants are then ordered according to the statistic for the differentiating ranked selection. In other words, if two or more participants have the same index, the statistics for the tied participants' ranked selections are compared.

In an optional embodiment, the reward is pari-mutual. That is, in an optional embodiment, the wagers are pooled, a percentage is deducted from the pooled wagers to be retained by the contest operator, and the remaining pool is divided among the winner or winners.

It is an object of the present invention to provide a method for operating a contest in which participants select a subset from a finite pool of competitors in an event, the winning participant determined by the cumulative performance of the subset during an event.

BRIEF DESCRIPTION OF THE DRAWINGS

FIG. 1 is a flowchart of an embodiment of a method according to the present invention.

DESCRIPTION

Reference is now made to the figures wherein like parts are referred to by like numerals throughout. It is important to note that the method of the present invention could be utilized in person at a sports book or in a sports pool or could be incorporated into software operating on a general purpose computer, gaming machine, or kiosk operating independently or networked with other general purpose computers, gaming machines, or kiosks. For example, in one optional embodiment, the method of the present invention could be embodied in software based at a server communicating with participants' general purpose computers over the Internet. Similarly, in an alternate optional embodiment, the method could be incorporated into software residing on a plurality of terminals, such as gaming machines, kiosks, or general purpose computers communicating over a network such as a local area network ("LAN") or wide-area network ("WAN").

With reference to FIG. 1, the method of the present invention applies to competition events, optionally sporting events, of the type with a finite number of competitors. For example, the competition event or events could be a tournament, such as golf or tennis, or a set of competitive games, such as the National Collegiate Athletic Association ("NCAA") basketball tournament or the schedule of National Football League ("NFL") games for a given day. It is also contemplated that the competitors in the method of the present invention could be individuals, teams, individual members of teams, or the like. Examples of events having finite numbers of competitors that could be used with the method of the present invention are given in Tables 1 and 2 below.

TABLE 1

| Home Team | Visiting Team |
|---|---|
| Northwestern | Minnesota |
| BYU | California |
| Tennessee | Alabama |
| Florida State | Florida |
| UCLA | USC |
| Texas | Texas A&M |
| Michigan | Ohio State |
| Stanford | Oregon |

TABLE 2

| U.S. Open |
|---|
| Tiger Woods |
| Phil Mickelson |
| Greg Norman |
| Nick Faldo |
| Jack Nicklaus |
| John Daly |
| Nick Price |
| David Duval |

The present method could be played as a wagering game, such as at a sports book or in a sports pool. Alternatively, the method could be played as a promotion, contest, or the like in which players are not required to make a wager. While the examples below describe a wagering game, it is contemplated that the present method may not require the placing of a wager or the rewarding of a prize. Therefore, the examples below should be considered exemplary and not restrictive.

According to one optional embodiment of the method of the present invention, as shown in FIG. 1, a participant makes a wager 10 and selects a predetermined number (n) of competitors from the finite set 12. In the example of Table 1, on a day with a schedule of eight college football games each participant may be allowed to select five teams as shown in Table 3.

TABLE 3

| Participant 1 | Participant 2 | Participant 3 |
|---|---|---|
| Northwestern | Minnesota | Minnesota |
| California | Alabama | California |
| Florida | Florida | Tennessee |
| Texas | Michigan | Florida State |
| Stanford | Oregon | UCLA |

When used in conjunction with an event featuring head to head competitions, the participants may optionally be restricted from selecting teams playing against each other. For example, if a game between Tennessee and Alabama is among the finite set, a participant may be restricted from selecting both Tennessee and Alabama. Alternatively, when used in conjunction with an event with a tournament-type format such as that shown in Table 2, a participant may be allowed to select a fixed number of competitors from the set of competitors as shown in Table 4.

TABLE 4

| Participant 1 | Participant 2 | Participant 3 |
|---|---|---|
| Tiger Woods | Tiger Woods | Tiger Woods |
| Greg Norman | Phil Mickelson | Phil Mickelson |
| Nick Faldo | Jack Nicklaus | Greg Norman |
| Nick Price | John Daly | John Daly |
| David Duval | David Duval | Nick Price |

The participant records the participant's selections. In an optional software embodiment, the recordation may optionally include storing participants' selections in a database. In an optional embodiment, the participant may also rank 14 the selections as shown in Tables 5 and 6 for use in an optional tie-breaking procedure described below.

TABLE 5

| Participant 1 | Participant 2 | Participant 3 |
|---|---|---|
| 1. Texas | 1. Alabama | 1. Florida State |
| 2. Florida | 2. Oregon | 2. Minnesota |
| 3. California | 3. Florida | 3. UCLA |
| 4. Stanford | 4. Minnesota | 4. California |
| 5. Northwestern | 5. Michigan | 5. Tennessee |

TABLE 6

| Participant 1 | Participant 2 | Participant 3 |
|---|---|---|
| 1. Tiger Woods | 1. Tiger Woods | 1. Greg Norman |
| 2. Nick Price | 2. David Duval | 2. Tiger Woods |
| 3. Greg Norman | 3. Phil Mickelson | 3. Phil Mickelson |
| 4. Nick Faldo | 4. John Daly | 4. Nick Price |
| 5. David Duval | 5. Jack Nicklaus | 5. John Daly |

With continued reference to FIG. 1, at a predetermined point in the event or events wagered upon, such as completion 16 of the event or events, halftime, or the like, an index (I) is calculated 18 for each participant based on the aggregate performance of all the participant's selections. Thus, the index (I) is calculated using one or more selected statistics ($S_x$) generated by a competitor's performance in the event or events. It is contemplated that any statistic or group of statistics ($S_x$) generated during the event or events could be used. It is likewise contemplated that individual or team statistics ($S_x$) could be used. For example, where each participant selects n competitors and the event or events generate a statistic ($S_x$) for each of the competitors (n), the index (I) is given by the following formula:

$$I = \sum_{x=1}^{n} S_x$$

In an optional embodiment in which individual players in a team event are the finite pool of competitors, the statistic ($S_x$) could be any statistic or any group of statistics ($S_x$) maintained in the event or game. In such an example, rather than selecting the competitor who will win, the object may optionally be to select the competitors projected to perform the best without regard to that competitor's team's performance, e.g. top scorers for a particular day's slate of games. In an embodiment in which a group of statistics are used for each competitors, e.g. top scorers/rebounders for a particular day's slate of games, the group of statistics for each competitor could be reduced to a single aggregate statistic ($S_x$) for that competitor by summing, weighted summing, or the like before calculating an index (I) for the participant's subset. In another optional embodiment, final score or margin of victory (or loss) may optionally be used as the statistic ($S_x$) and the index (I) may be the sum of the final scores or margins of victory or loss. In such an alternate embodiment, the object may be to select the competitors that will win or win by the largest margin, respectively. In the college football example of Tables 1, 3, and 5 above, an index (I) may be calculated using the sum of the margins of victory or loss as shown in Table 7.

TABLE 7

| | Outcome | Margin of Victory or Loss |
|---|---|---|
| Participant 1 | | |
| 1. Texas | Won 31 - 17 | +14 |
| 2. Florida | Won 24 - 10 | +14 |
| 3. California | Lost 17 - 26 | −9 |
| 4. Stanford | Won 7 - 3 | +4 |
| 5. Northwestern | Won 32 - 16 | +16 |
| | Index: | +39 |
| Participant 2 | | |
| 1. Alabama | Won 21 - 7 | +14 |
| 2. Oregon | Lost 3 - 7 | −4 |
| 3. Florida | Won 24 - 10 | +14 |
| 4. Minnesota | Lost 16 - 32 | −16 |
| 5. Michigan | Won 38 - 33 | +5 |
| | Index: | +13 |
| Participant 3 | | |
| 1. Florida State | Lost 10 - 24 | −14 |
| 2. Minnesota | Lost 16 - 32 | −16 |
| 3. UCLA | Won 24 - 23 | +1 |
| 4. California | Lost 17 - 26 | −9 |
| 5. Tennessee | Lost 7 - 21 | −14 |
| | Index: | −52 |

Similarly, in the example of Tables 2, 4, and 6, the final score is used as the statistic ($S_x$) and the index (I) is given by the sum of the final scores as shown in Table 8.

TABLE 8

| | Final Score |
|---|---|
| Participant 1 | |
| 1. Tiger Woods | −15 |
| 2. Nick Price | −7 |
| 3. John Daly | +1 |
| 4. Nick Faldo | −5 |
| 5. David Duval | −8 |
| Index: | −34 |
| Participant 2 | |
| 1. Tiger Woods | −15 |
| 2. David Duval | −8 |
| 3. Phil Mickelson | −6 |
| 4. John Daly | +1 |
| 5. Jack Nicklaus | +3 |
| Index: | −25 |

TABLE 8-continued

| | Final Score |
|---|---|
| Participant 3 | |
| 1. Tiger Woods | −15 |
| 2. Greg Norman | −7 |
| 3. Phil Mickelson | −6 |
| 4. Nick Price | −7 |
| 5. John Daly | +1 |
| Index: | −34 |

As shown in FIG. 1, the participants are ordered 24 by index (I) and a predetermined number of participants are rewarded. It is worth noting that the ordering of participants by index (I) will depend on the type of event and the statistic ($S_x$) used to calculate the index (I). Thus, where margin of victory is the statistic ($S_x$) used, the greatest index (I) may be the winner. Similarly, when final score is the statistic ($S_x$) used, the greatest index (I) is the winner unless, like golf, better scores are lower, in which case, the lowest index (I) is the winner. Thus, in the example of Table 7, the winner is Participant 1, Participant 2 is second, and Participant 3 is third.

Likewise, in the example of Table 8, Participant 1 and Participant 3 tie for first place, and Participant 2 is second place. When two or more participants tie indexes (I) 20, the tie is broken by comparing the tied participant's selections to determine the distinguishing selections. The distinguishing selections are then compared and the tied participants are ordered according to the statistics of the distinguishing selections.

In a further optional embodiment, the participants' ranked selections are serially compared 22 according to rankings until a selection differentiates the tied participants. Thus, in the example of Table 8, the statistics ($S_x$) for each participants' first ranked selections are compared. Comparing the statistic for the first selection ($S_1$), the first selections had the same score, −15. Consequently, the statistics second selections ($S_2$) are compared. Similarly, because the second selections also had the same score, −7, the statistics for the third selections ($S_3$) are compared. In comparing the statistics for the third selections ($S_3$), however, it is noted that Participant 3's third selection scored −6 whereas Participant 1's third selection scored +1. Participant 3 is ranked 24 higher than Participant 1 because Participant 3's third selection generated a better statistic ($S_3$) than Participant 1's third selection (recalling that in golf, larger negative scores are desired). Thus, in the optional embodiment utilizing rankings to break ties, it may be appreciated that participants should rank 14 the competitors higher if the participant believes that the competitor will generate the better statistic ($S_x$) among the selections. In other words, the participant ranks 14 his best selections higher than his marginal selections.

In an optional embodiment, a predetermined number of participants are rewarded 26. Optionally, only the participant with the best index (I) is rewarded. Alternatively, a fixed number of the top participants are selected as winners with a reward going to each of the winners. For example, the participants with the top three indexes (I) may each receive a reward.

In an optional embodiment in which participants wager to participate in the contest, the wagers are optionally pooled. In such an optional embodiment, the operator of the present method may optionally take a percentage of the pooled wagers and divide the remaining pool among the winning participants. As an example, the operator could take fifteen percent of the pooled wagers. The operator could then divide the remainder of the pooled wagers as follows: forty percent to first place participant, thirty percent to the second place participant, twenty percent to the third place participant, and ten percent to the fourth place participant.

While certain embodiments of the present invention have been shown and described it is to be understood that the present invention is subject to many modifications and changes without departing from the spirit and scope of the claims presented herein.

I claim:

1. A method for conducting a contest for a plurality of participants, the outcome of said contest determined by a set of competition events in which a finite set of competitors compete head to head, each competitor's performance, including those competitors that do not win the competition event, generating at least one statistic during said competition events, comprising:

each participant selecting a subset of predetermined size from among said finite set of competitors, the subset including at least two competitors, said participants excluded from selecting competitors competing head to head;

at a predetermined point during said sporting event, computing an index for each participant by summing the statistics associated with each competitor in each participant's subset without regard to the relationship of the competitors in the participant's subset;

ordering participants according to said index; and resolving ties among participants by comparing competitors in the tied participants' subsets and, if a selection differentiates the tied participants, ordering the tied participants according to the statistics of the differentiating selection.

2. The method of claim 1, further comprising:

each participant ranking the competitors in the participant's subset whereby in resolving ties, competitors in the tied participants' subsets are serially compared by ranking and, if a selection differentiates the tied participants, ordering the tied participants according to the statistics of the differentiating selection.

3. The method of claim 1, further comprising:

each participant placing a wager; and issuing a reward to a predetermined number of participants by order.

4. The method of claim 3, further comprising pooling said wagers whereby said reward is a predetermined portion of said pool.

5. A method for conducting a contest for a plurality of participants, the outcome of said contest determined by the result of a set of competition events in which a finite set of competitors compete head to head, each competitor's performance, including those competitors that do not win the competition event, generating a statistic at the completion of said competition events, comprising:

each participant placing a wager;

each participant selecting a subset of predetermined size from among said competitors, the subset including at least two competitors, said participants excluded from selecting competitors competing head to head;

each participant ranking the competitors in the participant's subset;

upon completion of said sporting event, computing an index for each participant according to the formula $$I = \sum_{x=1}^{n} S_x$$

where I is said index, s is said statistic for each competitor in a participant's subset, and n is said predetermined number of competitors in a subset;

ordering participants according to said index;

resolving ties among participants by serially comparing competitors in the tied participants' subsets by ranking and, if a selection differentiates the tied participants, ordering the tied participants according to the statistics of the differentiating selection; and rewarding a predetermined number of participants by order.

6. The method of claim 5, further comprising pooling said wagers whereby said reward is a predetermined portion of said pool.

* * * * *